United States Patent [19]

Sanford

[11] Patent Number: 5,071,382

[45] Date of Patent: Dec. 10, 1991

[54] TOYS

[76] Inventor: Richard Sanford, R.D. #1, Box 24, Nineveh, N.Y. 13813

[21] Appl. No.: 559,147

[22] Filed: Jul. 27, 1990

[51] Int. Cl.[5] ..... A63H 33/28

[52] U.S. Cl. ..... 446/015; 446/61; 446/16; 446/21

[58] Field of Search ..... 446/15, 16, 61, 46, 446/17, 18, 19, 20, 21

[56] References Cited

U.S. PATENT DOCUMENTS

| | | | |
|---|---|---|---|
| 1,877,120 | 9/1932 | Boehme | 446/61 |
| 3,002,314 | 1/1960 | Brottman | 446/15 |
| 3,008,263 | 2/1959 | Ellman | 446/15 |
| 3,109,255 | 3/1962 | Hein | 446/15 |
| 3,600,842 | 8/1971 | Bryman | 446/15 |

*Primary Examiner*—Robert A. Hafer
*Assistant Examiner*—D. Kenealy
*Attorney, Agent, or Firm*—Stephens, Richard G.

[57] ABSTRACT

A model airplane throw toy includes a tail end carried ring which may be angularly adjusted relative to the longitudinal axis of the model airplane to provide different sizes and quantities of bubbles to be produced as the model airplane is thrown.

4 Claims, 3 Drawing Sheets

TOYS

My invention relates to bubble-producing flying toys, and in particular to a novel and new form of toy which provides more entertainment value to persons of a given age group.

Various forms of flying bubble-producing toys are known, including, for example, the toys shown in the following prior patents:

| | | | |
|---|---|---|---|
| 3,022,314 | Brottman | 3,008,263 | Ellman |
| 3,323,250 | Gibbons | 3,600,842 | Bryman |
| 3,745,693 | LaFata | 4,184,284 | Rogahn |

The prior art includes various bubble-producing toys which are held by wand-like members, and other bubble-producing toys which are held by and propelled by operator manipulation of strings, or like flexible cords. It is believed that such wand-like and string-captured bubble-producing toys may offer considerable amusement to very small children, but that they offer little to children who are a bit older and a bit more sophisticated. One object of the present invention is to provide a bubble-producing flying toy which is a "throw" toy, as distinguished from a wand-captured or string-manipulated toy.

A child who directly throws a model airplane achieves better recognition of actual airplane motion than a child who waves a wand, or one who manipulates strings. Wand and string-captured model airplane toys often simulate dangerously great rates of turn and impart a false sense of proper airplane flight. A primary object of the present invention is to provide a bubble-producing throw-type model airplane toy.

Various bubble-producing toys provide bubbles of varying sizes and shapes, generally in a random or unplanned sequence or pattern. Another object of the present invention is to provide a bubble-producing throw toy in which different types of bubbles may be produced by operator adjustment in a planned or intended manner.

It is beneficial in a pedagogical sense if the operator of the throw toy can be given a feeling of some elementary aerodynamic principles as he or she operates the toy.

Other objects of the invention will in part be obvious and will in part appear hereinafter.

It will thus be seen that the objects set forth above, among those made apparent from the preceding description, are efficiently attained, and since certain changes may be made in the above construction without departing from the scope of the invention, it is intended that all matter contained in the above description or shown in the accompanying drawing shall be interpreted as illustrative and not in a limiting sense.

For a fuller understanding of the nature and objects of the invention reference should be had to the following detailed description taken in connection with the accompanying drawings, in which.

Figure 3:
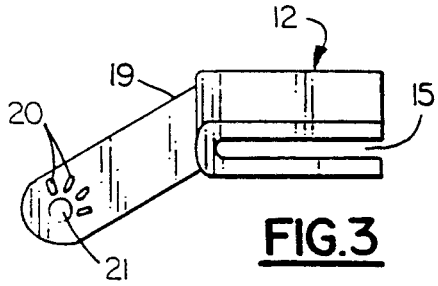
Figure 2:
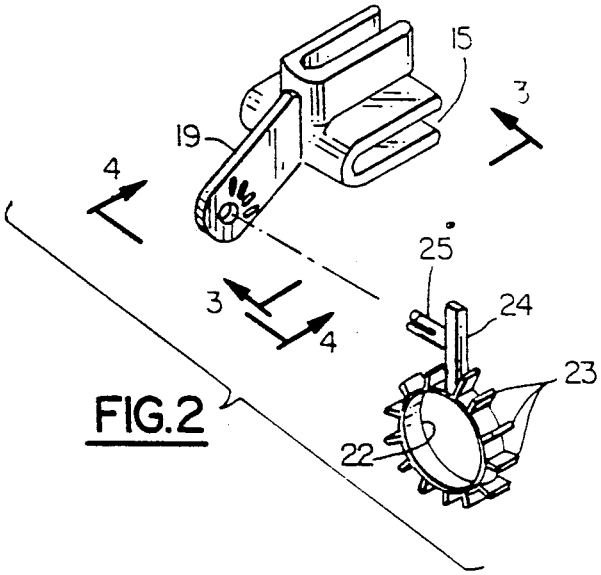
FIG. 2 is an assembly view illustrating a connection of a bubble-ring member to the tail end of the model airplane of FIG. 1.
Figure 4:
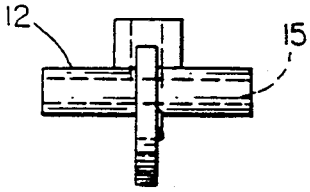

FIGS. 3 and 4 are side and end views taken at lines 3—3 and 4—4 in FIG. 2, respectively.

Figure 5:
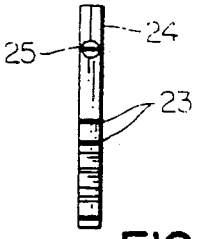
Figure 6:
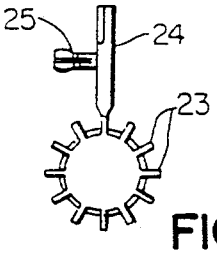

FIGS. 5 and 6 are end and side views of the bubble-producing ring member.

Figure 7:
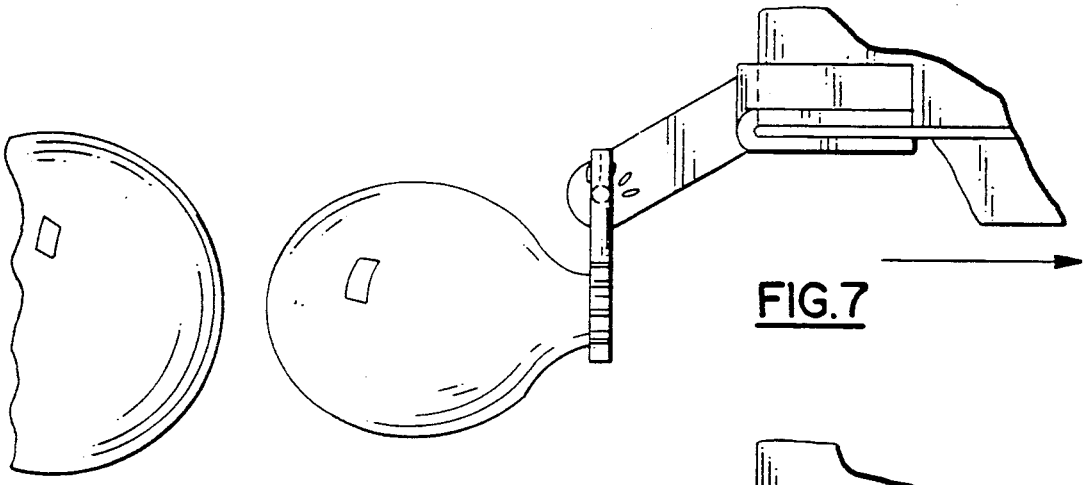
Figure 8:
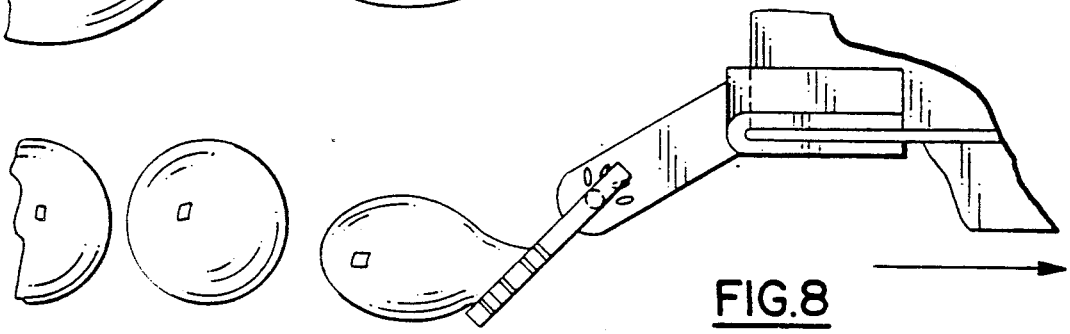
Figure 9:
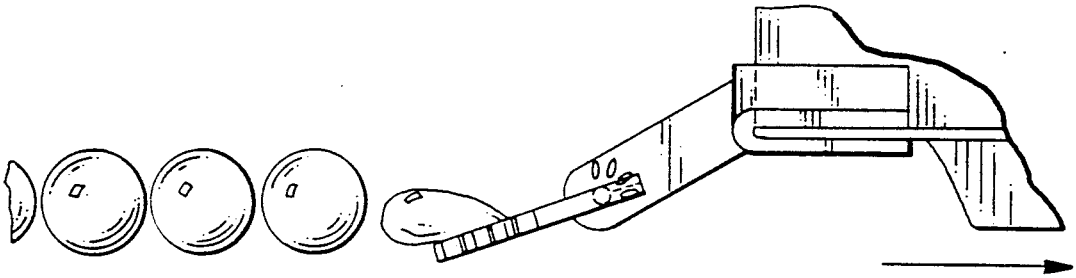

FIGS. 7 to 9 are side views generally illustrating the variation in bubble production as the bubble-ring member is adjusted to several different angles.

Figure 10:
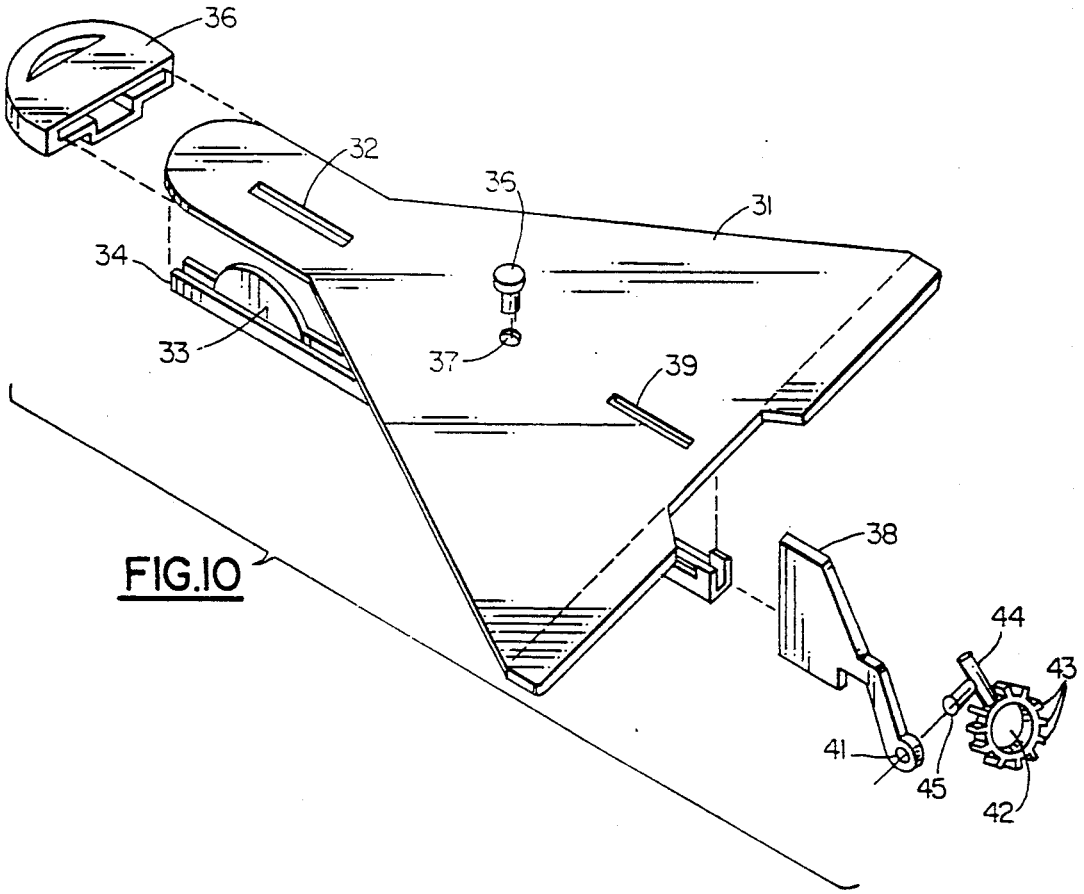

FIG. 10 is an assembly view illustrating a preferred form of the invention.

Figure 11:
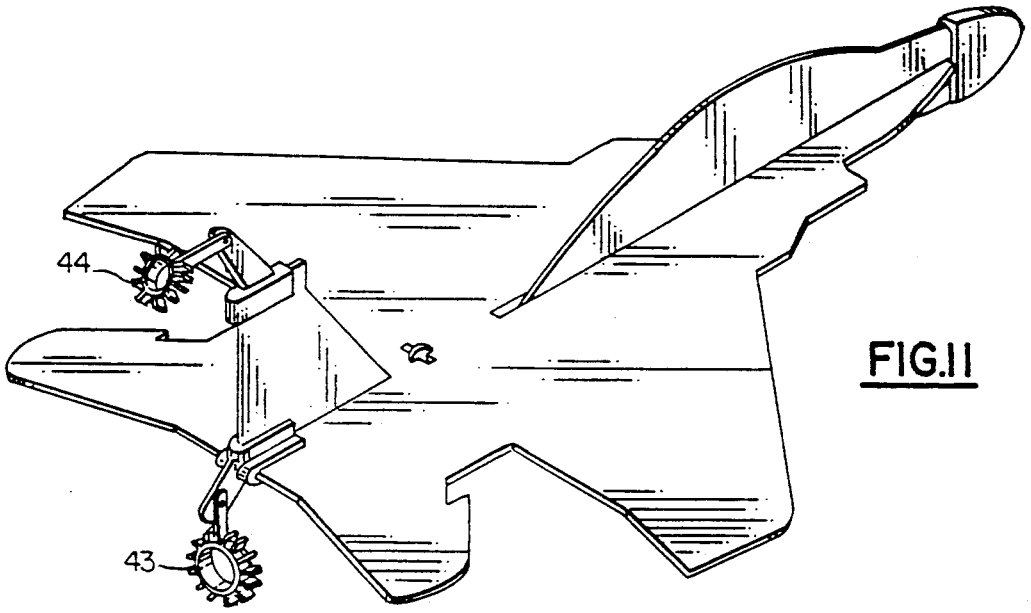

FIG. 11 illustrates one possible modification of the invention.

Figure 1:
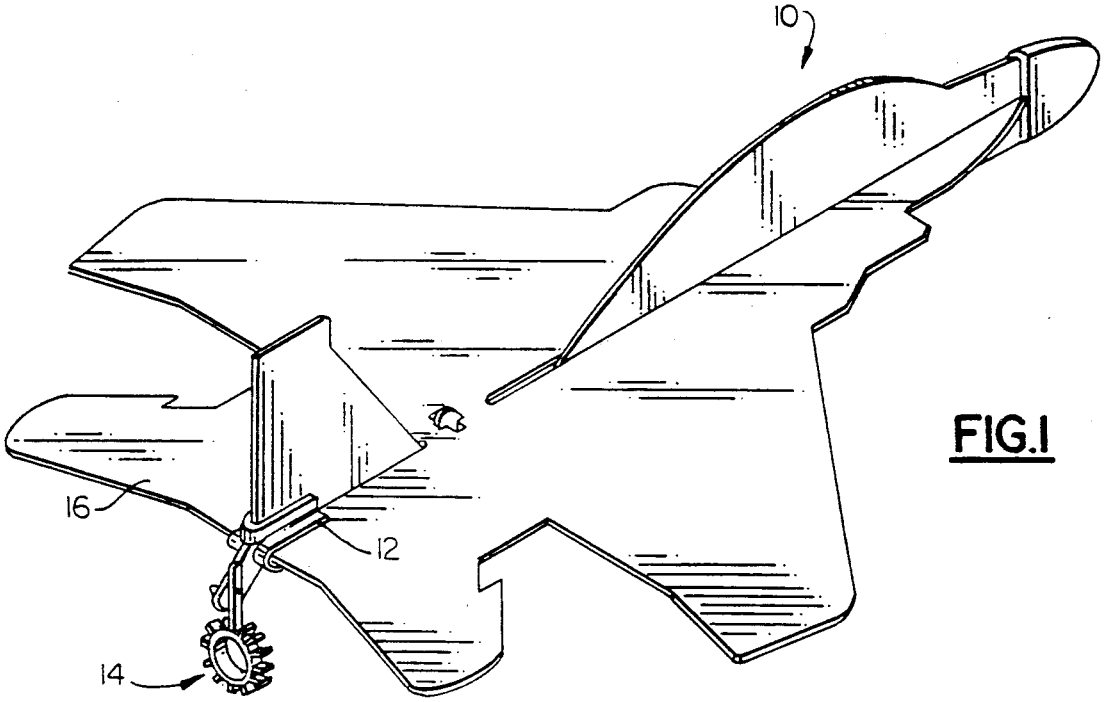
FIG. 1 is an isometric view of one form of model airplane assembly incorporating a first form of the invention.

Referring now to FIG. 1 there is shown a model airplane toy 10 which is quite conventional in most respects, and which is shown differing from many such toys only in that it includes a tail-fitted support member 12 which adjustably supports a ring member 14. The wing, body and tail members are preferably formed of rigid plastic foam. Tail member 12 has a horizontal slot 15 (FIGS. 3 and through which the horizontal tail of the airplane assembly extends and nests. Tail support member 12 is also provided with flanges 17,17 defining an intermediate slot 18 into which a portion of the vertical tail is fitted. Tail member 12 may and preferably is glued or cemented to the horizontal and vertical tail members of the model airplane.

Tail member 12 also is provided with a rearwardly-extending tab portion 19, on which a plurality of raised bosses 20,20 (four are shown) are arranged in a semicircular array about a through hole 21. Ring member 14 comprises a circular ring portion carrying a plurality of radially outwardly extending tabs or fins 23,23 situated around the periphery of the ring portion. Fins 23,23 increase the surface area of the ring member and provide a facility to promote capillary attraction, thereby materially increasing the amount of soap bubble solution retained on the ring after a dipping. Ring member 14 also includes a tab portion 24 carrying a partially slit shaft 25. The shaft extends through hole 21 and its outer end is slightly spread to retain the ring member on the tail support member. However, the split shaft provides enough resilience that the ring member may be angularly rotated to any of the three discrete alternative positions shown in FIGS. 7–9. In any of the three discrete positions, tab 24 seats between a pair of the bosses 20,20, holding the ring member at a selected angle.

As is made diagrammatically quite clear in FIGS. 7–9, angular adjustment of the ring member relative to the nose-tail or axis of the model airplane distinctly changes the nature of and quantity of the bubbles which are produced as the toy airplane is thrown in the conventional forward direction. Adjustment of the ring member so that its plane is substantially perpendicular to the mentioned axis of the toy, larger and fewer bubbles are produced, while canting the ring relative to the mentioned axis causes smaller and more bubbles to be produced.

In the preferred form of the invention shown in FIG. 10, a wing member 31 of delta shape, and preferably formed from a rigid plastic foam, such as polystyrene foam, includes a forward slot 32 through which a tab 33 molded integral with rail 34 protrudes. Rail 34 is generally channel shaped, with a central groove or slot as shown. The groove preferably is slightly tapered, so that several parts (36 and 38) to be mentioned below can be pushed into the slot of rail 34 to be held with a force fit. A plastic nose member 36 fits on the forward ends of wing member 31 and rail 34, to maintain the forward end of rail 34 against the forward end of wing member 31, to weight the nose of the assembly to appropriately locate the center-of-gravity relative to the lift force vector as the model airplane is thrown, and to protect the leading edge central portion of the wing member from damage. A push p[n 36 extends through a hold 37 in wing member, preferably with a force fit into the central channel or groove of rail 34, though pin 36 can be cemented or glued if desired. A vertical tail piece 38 is pushed down through rear slot 39 in wing 31, to make a force fit into rail 34. A ring member 42–45 assembly which may be identical to assembly 22–25 of FIG. 2 fits in hole 41 tail piece 38 for angular adjustment, as in the previously described embodiment, to provide different sizes and quantities of bubbles. Bosses (not visible in FIG. 10) are provided to fix the ring member assembly at discrete angular positions.

FIG. 11 illustrates a modified form of the invention having two bubble ring members 43,44 mounted on the vertical tail piece of a model plane, which is only partially shown in FIG. 11, but which otherwise may take the form of the plane of FIGS. 1–9 or the form of FIG. 10. Where two ring members are provided, it is desirable either that both be centered on the longitudinal axis of the plane, or that they both be displaced equal amounts on opposite sides of the longitudinal axis, so as to minimize the production of any turning or pitching moments. If the two ring members in FIG. 11 are adjusted to different combinations of angular positions, it is possible to provide desirable gentle net pitching and turning moments. While both ring members shown in FIG. 11 are shown as being angularly adjustable, it should be noted that one could be adjustable and the other fixed. Now it will become apparent that plural bubble ring members may be mounted on the wing members, on either leading or trailing edges, to provide plural bubble sources.

It is also to be understood that the following claims are intended to cover all of the generic and specific features of the invention herein described, and all statements of &:he scope of the invention which, as a matter of language, might be said to fall therebetween.

The embodiments of the invention [n which an exclusive property or privilege is claimed are defined as follows:

1. A model airplane assembly having means for producing bubble a generally ring-shaped member, and means for adjustably fixing said ring member at each of a plurality of different angles between the plane of said ring member and the longitudinal axis of said model airplane, thereby to cause different sizes and quantities of bubbles to be produced as said assembly is thrown.

2. The assembly of claim I wherein said ring-shaped member has a plurality of outwardly radially-extending fins spaced about its periphery.

3. The assembly of claim 1 wherein said ring member is rotatably supported at the tail end of said model airplane on a member having a plurality of bosses, thereby allowing said ring member to be adjusted to a predetermined plurality of discrete angular positions.

4. The assembly of claim 1 having a plurality of ring-shaped members affixed to said model plane.

* * * * *

UNITED STATES PATENT AND TRADEMARK OFFICE

CERTIFICATE OF CORRECTION

PATENT NO. : 5,071,382

DATED : Dec. 10, 1991

INVENTOR(S) : Richard Sanford

It is certified that error appears in the above-identified patent and that said Letters Patent is hereby corrected as shown below:

Col. 2, line 19, after "Figs. 3 and" insert --4)--

Col. 2, line 48, after "or" insert --x--

Col. 3, line 5, change "p[n" to --pin--

Col. 3, line 5, change "hold" to --hole--

Col. 4, line 9, change "&:he" to --the--

Col. 4, line 11, change "[n" to --in--

Col. 4, line 15, change "bubble" to --bubbles comprising--

Col. 4, line 21, change "I" to --1--

Signed and Sealed this

Twenty-seventh Day of April, 1993

*Attest:*

MICHAEL K. KIRK

*Attesting Officer*

*Acting Commissioner of Patents and Trademarks*